United States Patent [19]

Entrikin et al.

[11] 3,980,364

[45] Sept. 14, 1976

[54] ROLLER BRACKET ASSEMBLY FOR DRAWERS

[75] Inventors: Ronald K. Entrikin; Richard D. Livingston, both of Rockford, Ill.

[73] Assignee: Amerock Corporation, Rockford, Ill.

[22] Filed: June 4, 1975

[21] Appl. No.: 583,546

[52] U.S. Cl. ..... 312/341 R; 308/3.8; 312/343; 312/346

[51] Int. Cl.[2] ..... A47B 88/04; A47B 88/14

[58] Field of Search ..... 312/242, 321, 332, 342, 312/343, 344, 345, 346, 347, 349, 350; 308/3.8

[56] References Cited

UNITED STATES PATENTS

| | | | |
|---|---|---|---|
| 1,078,715 | 11/1913 | Cherry | 312/321 |
| 1,169,632 | 1/1916 | Goldsmith | 312/321 |
| 1,569,158 | 1/1926 | Tobey | 312/350 X |
| 2,739,028 | 3/1956 | Siggia | 312/350 X |
| 2,843,444 | 7/1958 | Nelson | 312/332 X |
| 2,997,355 | 8/1961 | Preble | 312/342 |
| 3,094,363 | 6/1963 | Fremstad et al. | 312/332 X |
| 3,682,524 | 8/1972 | Starace | 312/345 X |
| 3,694,049 | 9/1972 | Gutner | 312/345 X |
| 3,716,279 | 2/1973 | Anderson et al. | 312/349 X |

*Primary Examiner*—Paul R. Gilliam
*Assistant Examiner*—Carl F. Pietruszka
*Attorney, Agent, or Firm*—Leydig, Voit, Osann, Mayer & Holt, Ltd.

[57] ABSTRACT

A roller bracket assembly includes a first and second generally planar wings connected perpendicular to each other by a narrower intermediate panel slanted at forty-five degrees with respect to both wings. Two horizontally spaced rollers are journaled on the first wing adjacent the forward and rearward end portions thereof for guiding and supporting a drawer to slide in and out of an opening in a cabinet. The first wing is secured to the face frame of the cabinet by two screws which extend through vertically spaced openings formed through the forward end portion of the wing. In addition, the screws serve to partially support the first wing vertically within the cabinet with further vertical support being provided by bosses formed around the openings and protruding outwardly from such wing and into the face frame. A third screw extends through another opening formed through the forward inner corner of the second wing to secure the latter wing to the horizontal member of the face frame. A tab is integrally formed with the second wing adjacent the third screw-receiving opening and protrudes downwardly from the wing to engage the forward surface of the face frame to help keep the bracket from moving laterally within the cabinet in service use.

2 Claims, 6 Drawing Figures

Fig. 1.
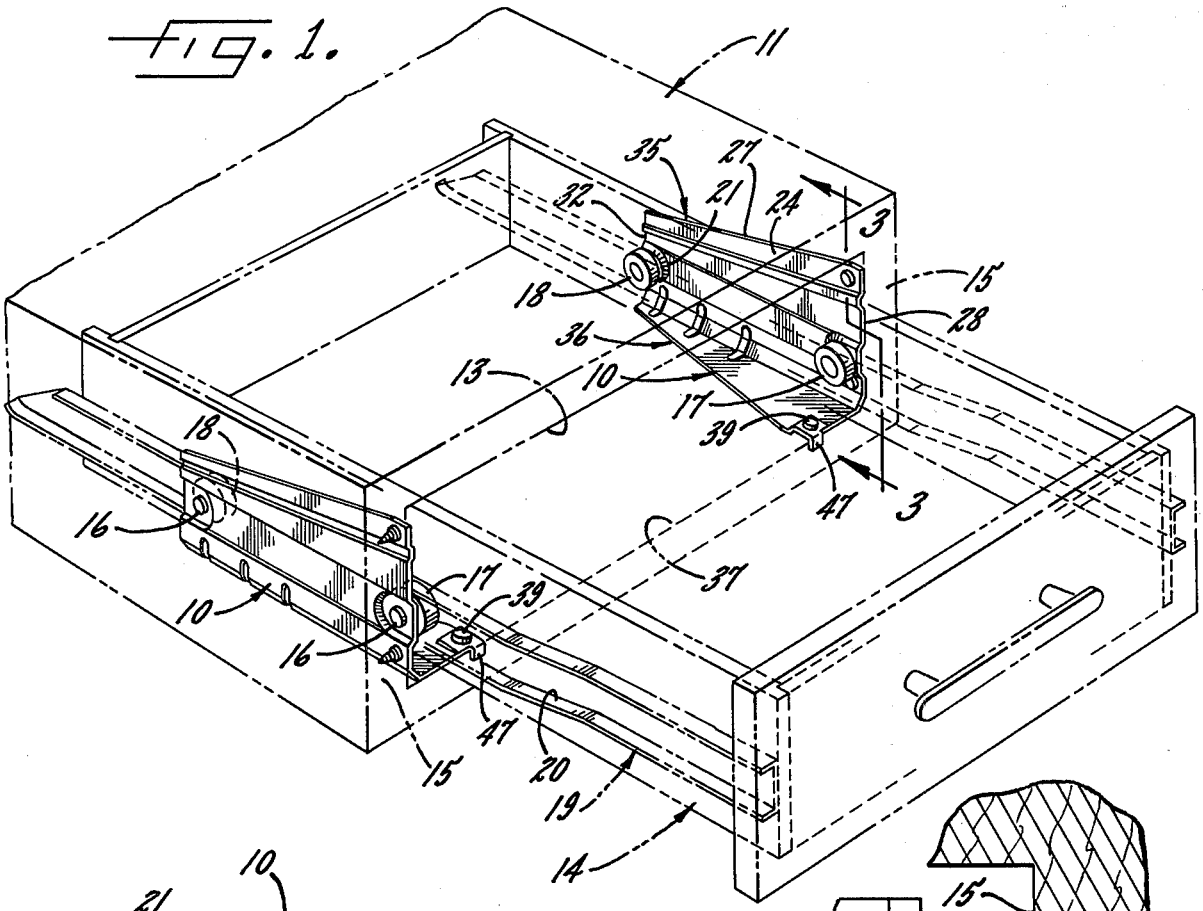
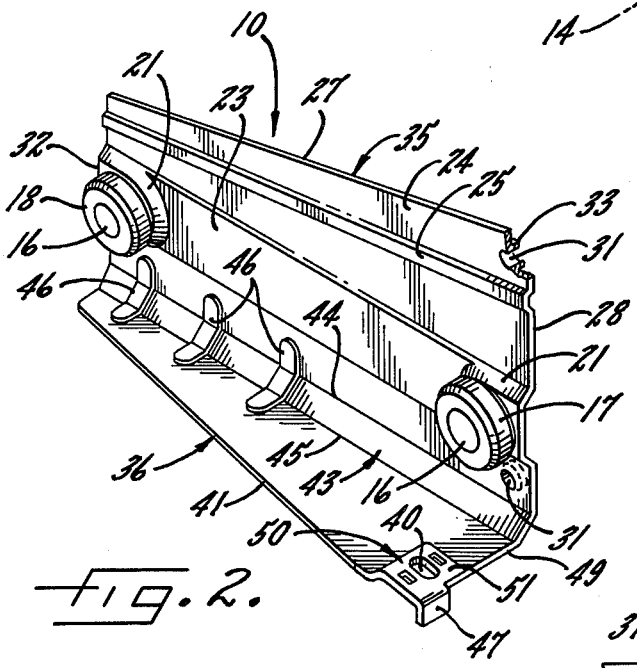
Fig. 2.
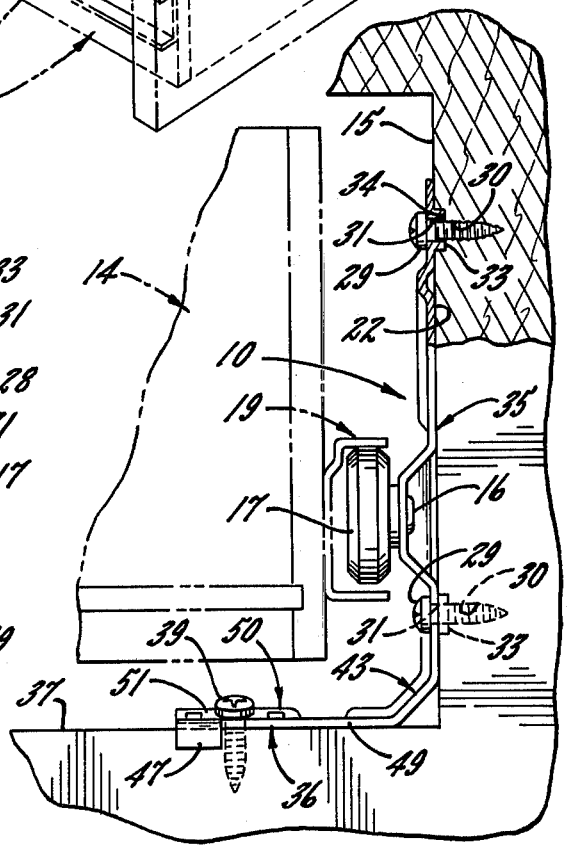
Fig. 3.

ROLLER BRACKET ASSEMBLY FOR DRAWERS

BACKGROUND OF THE INVENTION

This invention relates to a roller bracket assembly for supporting a drawer for in-and-out sliding in an opening in a cabinet. The invention has more particular reference to a bracket assembly of the type including a generally planar mounting plate which supports horizontally spaced rollers and which may be attached to the cabinet adjacent one side of the opening so that the rollers may engage and support the drawer for sliding movement between open and closed positions relative to the opening.

As shown in Anderson et al U.S. Pat. No. 3,716,279, one bracket of the foregoing type is particularly adapted for mounting on the face frame of the cabinet with the rearward end portion of the bracket extending freely into the cabinet, the forward end portion of the bracket being secured to a vertical member of the face frame such as by means of screws which extend through screw-receiving openings formed through the bracket. Bosses protruding outwardly from the bracket from around the openings extend into the vertical face frame member to aid in supporting the bracket within the cabinet.

SUMMARY OF THE INVENTION

The primary aim of the present invention is to provide a new and improved bracket assembly of the foregoing general character in which the unsupported rearward end portion of the bracket is kept from shifting laterally in service use so that the bosses are kept from chewing into the wood of the face frame to cause loosening of the bracket within the cabinet. A more detailed object is to achieve the foregoing by constructing the bracket so that rearward end portion of the bracket is kept from easily being moved in an outward direction relative to the forward end portion once the latter is secured to the face frame.

A further object of the present invention is to construct the bracket so that it may be used within a cabinet in which the drawer opening has either rounded or square corners.

The invention also resides in the novel construction of the bracket to include two generally planar wings extending generally perpendicular to each other to provide a connection between the bracket and both the horizontal and vertical members of the face frame.

Still further, the invention resides in the provision of an upset and inclined corner portion on the horizontal wing of the bracket to facilitate quick and easy mounting of the wing on the horizontal member of the face frame.

Also, the invention resides in the provision of a rearwardly elongated fastener-receiving opening within the inclined corner portion so as to provide for easy lateral positioning of the vertical wing of the bracket when being installed in the cabinet.

These and other objects and advantages of the present invention will become more apparent from the following detailed description when taken in conjunction with the accompanying drawings.

BRIEF DESCRIPTION OF THE DRAWINGS

FIG. 1 is a perspective view of a cabinet equipped with new and improved roller bracket assemblies embodying the novel features of the present invention.

FIG. 2 is a perspective view of one of the bracket assemblies.

FIG. 3 is an enlarged, fragmentary, cross-sectional view taken substantially along line 3—3 of FIG. 1.

DETAILED DESCRIPTION OF THE PREFERRED EMBODIMENT

Figure 4:
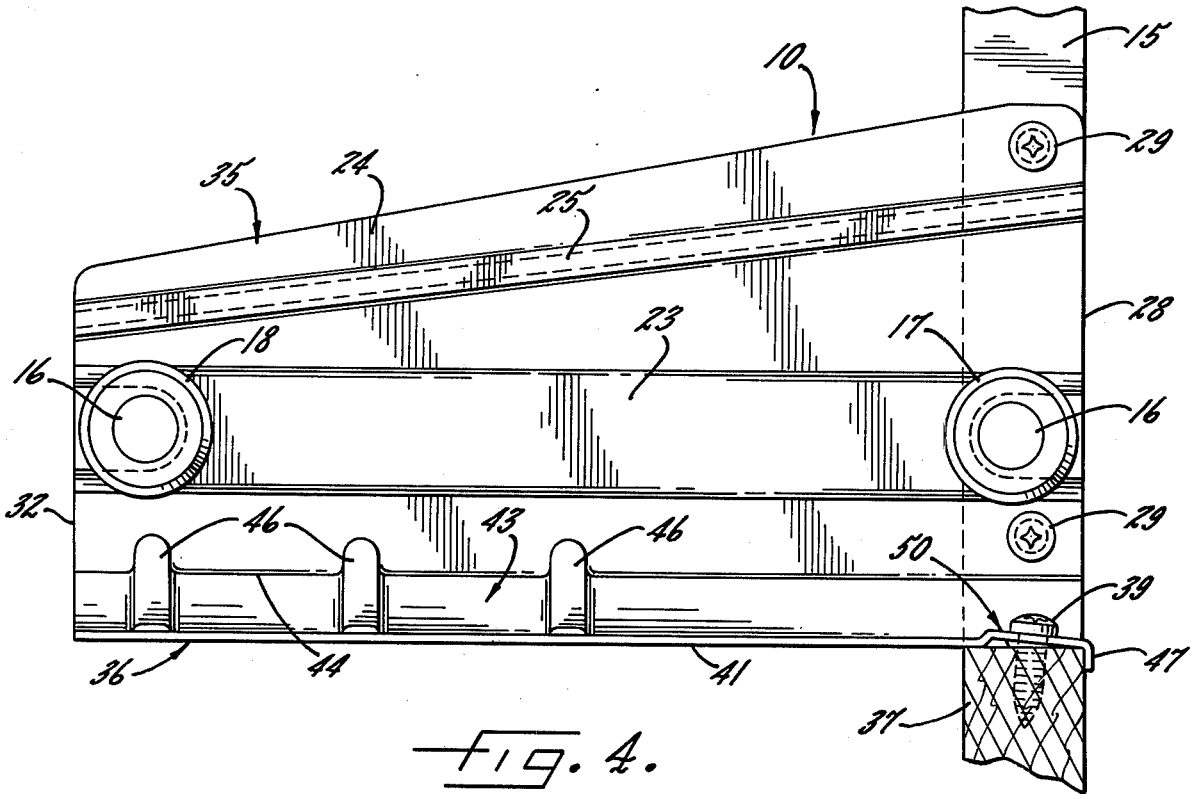
FIG. 4 is an enlarged, fragmentary, elevational view of the bracket assembly showing the assembly mounted within the cabinet.
Figure 5:
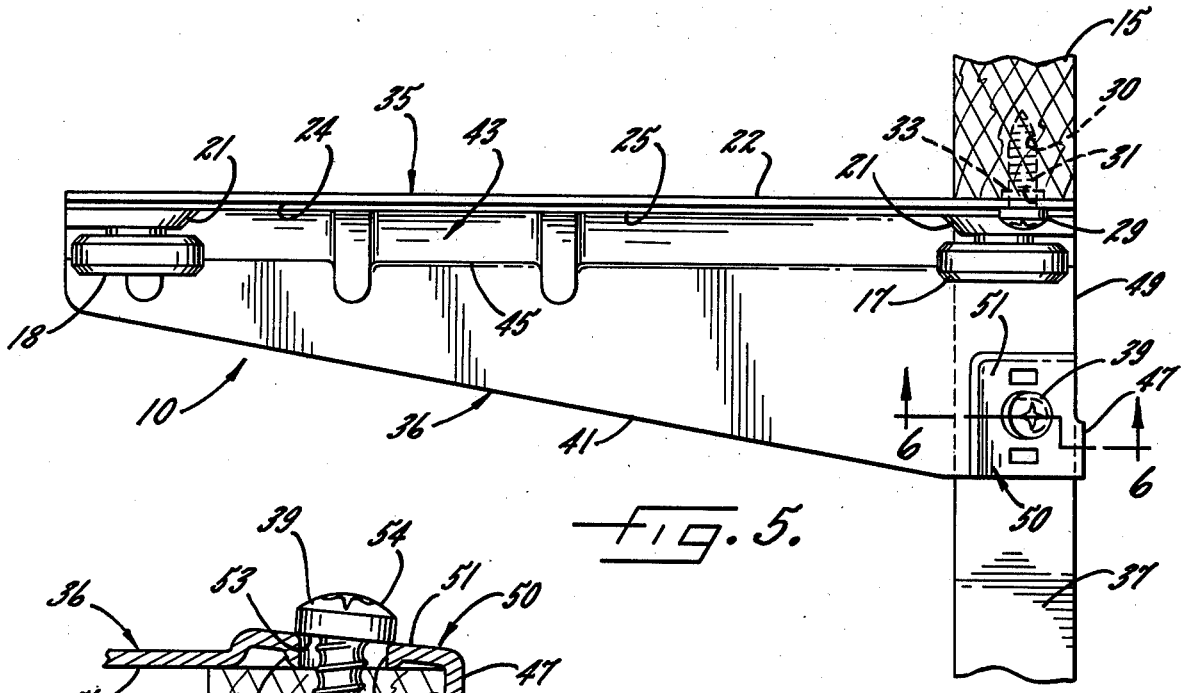
FIG. 5 is an enlarged, fragmentary plan view of the bracket assembly showing it mounted within the cabinet.

As shown in the drawings for purposes of illustration, the invention is embodied in a roller bracket assembly 10 adapted to be mounted within a cabinet 11 adjacent an opening 13 therein and serving to support a drawer 14 for in-and-out sliding in the opening. One bracket assembly is located at each side of the opening and, in this instance, the assemblies are attached to the inside edges of the opposed upright members 15 of the cabinet face frame. Secured to each bracket are two horizontally spaced and horizontally extending axles 16 which journal small anti-friction rollers 17 and 18. The latter fit within a channel-like track 19 (see FIG. 1) secured to the side of the drawer and thus support the drawer for relatively friction-free sliding within the cabinet. A dip or so-called "down ramp" 20 is formed intermediate the ends of each track so that, when the drawer is pushed rearwardly into the cabinet a predetermined distance, the down ramps ride across the rear rollers 18 and enable gravity to close the drawer automatically to a fully shut position. To avoid frictional contact between the track and the bracket assembly during sliding of the drawer, the rollers are supported on raised opposite end portions 21 of a rearwardly extending support rib 23 formed along the inner side 24 of the bracket. An additional but narrower support rib 25 extends along the bracket adjacent the upper edge 27 thereof and is slanted downwardly toward the larger rib upon progressing from the forward end 28 toward the rearward end 32 of the bracket.

As shown in FIG. 3, each bracket assembly 10 is attached to the vertical face frame member 15 by wood screws 29 or suitable fasteners which are received in a pair of vertically spaced holes 30 formed in the frame member. In addition, circular screw-receiving holes 31 are formed in the forward end portion of the bracket and include protruding bosses 33 which may fit into the holes 30 to help securely anchor the bracket assembly on the face frame. Herein, the circular openings or holes 31 in the bracket are located just rearwardly of the forward end 28 of the bracket and just forwardly of the axle 16 of the adjacent roller 17 (see FIG. 4). The bosses 33 are cylindrical and coaxial with the holes 31 and protrude a short distance outwardly from the outer side 22 of the bracket. The bosses are integral with the bracket and are formed as an incident to stamping the bracket.

When mounting the bracket assembly 10 in the cabinet 11, the bosses 33 may be fitted snugly into counter bores 34 (see FIG. 3) of the holes 30 and then the bracket assembly may be anchored to the vertical face frame member 15 by driving the screws 29 through the holes 31 and into the holes 30. As a result of the bosses, the bracket is held in place on the frame member not only by the clamping and frictional force exerted by the screws but also by the bosses bearing in shear against the material forming the walls of the counter bores.

In accordance with the primary aspect of the present invention, the bosses 33 are kept from chewing into the wood of the vertical face frame member 15 and loosening the bracket assembly 10 within the cabinet 11 by constructing the assembly so that the unsupported rearward end portion thereof is kept from shifting laterally in service use. For these purposes, the bracket assembly includes two generally planar wing members 35 and 36 connected together and extending generally perpendicular to each other. The rollers 17 and 18 are journaled on the upright wing 35 with the screw or fastener-receiving openings 31 and bosses 33 being formed in the forward end portion of such wing. The horizontal wing 36 extends inwardly from adjacent the vertical face frame member 15 for connection to a horizontal face frame member 37 by means of a fastener 39 such as a screw extending through a fastener-receiving opening 40 which is formed in the forward end portion of the horizontal wing. As a result of this construction, a solid three-point connection may be made between the bracket and the face frame of the cabinet so as to keep the rearward end portion of the bracket assembly from shifting laterally within the cabinet and eventually causing the assembly to loosen.

In the present instance, the horizontal wing 36 is a generally triangular member including an inner edge 41 slanted outwardly, that is, toward the upright wing 35 upon progressing rearwardly from the forward end portion of the bracket assembly 10. The upright wing is connected integrally with the horizontal wing by way of a slanted intermediate panel 43 extending downwardly and inwardly from the lower edge 44 of the upright wing to the outer edge 45 of the horizontal wing so as to lie within a plane forming a 45° angle with respect to vertical. Three spaced support ribs 46 extending across the rearward end portion of the panel and into the vertical and horizontal wings serve to keep the wings from being easily bent out of their normal positions with respect to each other and with respect to the panel. By virtue of this construction, the connection between the two wings is spaced inwardly from the projected corner between the two wings without any loss of strength so as to enable the bracket to be mounted easily on the face frame even within openings 13 having rounded instead of square corners.

To keep the rearward end portion of the bracket assembly 10 from swinging outwardly within the cabinet 11, a generally rectangular tab 47 formed integrally with the forward edge 49 of the horizontal wing 36 and adjacent the fastener-receiving opening 40. The tab projects downwardly from the wing in a substantially perpendicular direction relative thereto so the rearward surface 41 of the tab engages with the front surface of the horizontal face frame member 37 (see FIG. 6). In this way, the forward end portion of the bracket is kept from pivoting rearwardly relative to the vertical member 15 of the face frame and this, in turn, keeps the rearward end portion of the bracket from being moved laterally outward within the cabinet.

In accordance with another important aspect of the present invention, installation of the bracket 10 in the cabinet 11 is made easier by virtue of forming the fastener-receiving opening 40 in the horizontal wing 36 through an upset corner portion 50 at the inner, forward end corner of the horizontal wing. Advantageously, the upper surface 51 of the upset corner is inclined upwardly from the plane of the wing upon progressing rearwardly from the front edge 49. As a result, the screw 39 which extends through the opening may be turned into the horizontal face frame member 37 on an angle with respect to vertical so that the upper edge of the cabinet opening 13 avoids interferring with the driver used to tighten down the screw. Herein, the incline of the upper surface of such corner portion forms an angle of approximately three degrees with respect to horizontal. When the screw is tightened down, the underside 53 of the head 54 of the screw (see FIG. 6) abuts flatly against the inclined surface around the opening so as to provide a solid connection between the wing and the frame 37. In addition, a peripheral ridge 55 is formed integrally with the underside 56 of the wing and projects downwardly therefrom and around the opening 40 so that the lower edge of the ridge lies within the plane of the underside of the wing for solid engagement with the upper surface of the horizontal face frame member when the screw is tightened down.

Figure 6:
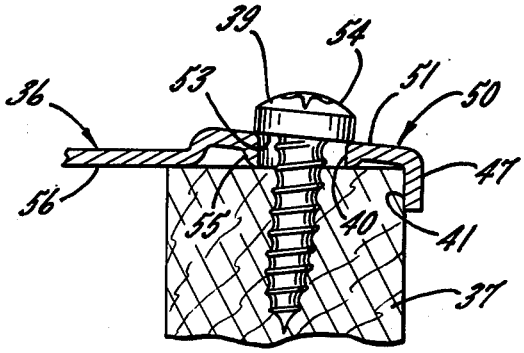
FIG. 6 is an enlarged, fragmentary, cross-sectional view taken substantially along line 6—6 of FIG. 5.

As shown in FIGS. 2 and 6, to aid in positioning the bracket 10 parallel with another similar bracket on the opposite side of the cabinet opening 13, the fastener-receiving opening 40 in the horizontal wing is elongated rearwardly with the length of the opening being substantially longer than its width. Accordingly, before tightening the screw 39 snugly against the wing 36, the elongated opening 40 permits the rearward end portion of the bracket to be moved slightly inwardly or outwardly to adjust the position of the upright wing 35 of the bracket on one side of the cabinet opening to parallel the corresponding wing of the bracket on the other side of the cabinet opening.

From the foregoing, it will be apparent that the present invention brings to the art a new and improved bracket assembly 10 which is adapted particularly for quick and easy mounting within different types of cabinet openings 13 and which is constructed advantageously to avoid becoming loose within the cabinet in service use. The two perpendicular wings 35 and 36 of the assembly provide for sturdy fastening of the bracket assembly to the face frame of the cabinet 11, while the slanted panel 43 connected between the two wings enables the bracket to be used in cabinet openings having either rounded or square corners. In addition, the depending tab 47 from the horizontal wing 36 serves as a stop to keep the rearward end portion of the bracket assembly from being swung outwardly to cause the bosses 33 to wear in the vertical member 15 of the face frame. Moreover, the inclined surface 51 of the upset corner portion 50 permits easy positioning of a driver to turn the screw 39 into the horizontal face frame member 37 while also providing for a solid connection between the horizontal wing and the screw head 54 for secure fastening of the wing to such member.

We claim as our invention:

1. A roller bracket assembly adapted to support a drawer for in and out sliding in an opening in a cabinet, said bracket assembly comprising a vertical wing having forward and rearward end portions, rollers journaled on the inner sides of said end portions to rotate about first and second horizontal axes, two vertically spaced fastener-receiving openings formed in said forward end portion, bosses protruding from the outer side of said forward end portion around said openings, a horizontal wing extending inwardly from the lower margin of said vertical wing, a third fastener-receiving opening formed through said horizontal wing within the forward end portion thereof and adjacent the inner edge of said horizontal wing, said third opening being elongated in a fore-and-aft direction, and a tab formed integrally with and depending from the extreme forward edge of said horizontal wing adjacent said third opening, said tab defining the forwardmost part of said bracket assembly.

2. A roller bracket assembly as defined by claim 1 including a flat intermediate panel connected between said vertical and horizontal wings and lying in a plane slanted upwardly and outwardly at about forty-five degrees from the outer edge of said horizontal wing to the lower edge of said vertical wing.

* * * * *